US008058577B2

(12) United States Patent
Tissot

(10) Patent No.: US 8,058,577 B2
(45) Date of Patent: Nov. 15, 2011

(54) TOUCH-SENSITIVE SURFACE ACTIVATION DEVICE FOR THE CONTROLS OF A VEHICLE

(75) Inventor: Jean Marc Tissot, Viuz en Sallaz (FR)

(73) Assignee: DAV, Creteil (FR)

( * ) Notice: Subject to any disclaimer, the term of this patent is extended or adjusted under 35 U.S.C. 154(b) by 595 days.

(21) Appl. No.: 11/722,151

(22) PCT Filed: Dec. 7, 2005

(86) PCT No.: PCT/EP2005/056564

§ 371 (c)(1),
(2), (4) Date: Jun. 3, 2008

(87) PCT Pub. No.: WO2006/067041

PCT Pub. Date: Jun. 29, 2006

(65) Prior Publication Data

US 2008/0289944 A1 Nov. 27, 2008

(30) Foreign Application Priority Data

Dec. 20, 2004 (FR) ..... 04 13609

(51) Int. Cl.
*H01H 9/00* (2006.01)

(52) U.S. Cl. .... 200/334; 200/600; 200/512; 200/51 LM

(58) Field of Classification Search ..... 200/600, 200/51 LM, 334, 1 B; 341/20–22, 33, 34, 341/24, 25; 345/168, 169, 173, 174
See application file for complete search history.

(56) References Cited

U.S. PATENT DOCUMENTS

| | | | | |
|---|---|---|---|---|
| 5,914,708 | A * | 6/1999 | LaGrange et al. | 345/179 |
| 6,157,372 | A * | 12/2000 | Blackburn et al. | 345/173 |
| 6,180,898 | B1 * | 1/2001 | Terada et al. | 200/51 LM |
| 7,019,225 | B2 * | 3/2006 | Matsumoto et al. | 200/5 R |
| 7,652,220 | B2 * | 1/2010 | Weiss | 200/600 |
| 2003/0121767 | A1 * | 7/2003 | Caldwell | 200/512 |
| 2004/0119700 | A1 * | 6/2004 | Ichikawa | 345/173 |
| 2004/0200699 | A1 * | 10/2004 | Matsumoto et al. | 200/1 B |
| 2005/0231332 | A1 * | 10/2005 | Nihei et al. | 340/286.13 |
| 2007/0080951 | A1 * | 4/2007 | Maruyama et al. | 345/173 |
| 2010/0123592 | A1 * | 5/2010 | Nurmi | 340/665 |

FOREIGN PATENT DOCUMENTS

| | | | |
|---|---|---|---|
| DE | 100 23 199 | A1 | 1/2001 |
| DE | 100 65 853 | C1 | 6/2002 |
| EP | 1 043 747 | A2 | 10/2000 |
| EP | 1 223 672 | | 7/2002 |
| FR | 2 798 329 | | 3/2001 |
| FR | 2 800 885 | | 5/2001 |
| WO | 2006/035341 | A1 | 4/2006 |
| WO | 2006/067041 | A1 | 6/2006 |

OTHER PUBLICATIONS

PCT Search Report for PCT/EP2005/056564; dated May 19, 2006.

* cited by examiner

*Primary Examiner* — Michael Friedhofer
(74) *Attorney, Agent, or Firm* — Daly, Crowley, Mofford & Durkee, LLP

(57) ABSTRACT

The invention relates to a touch-sensitive surface (3) activation device (1) for a motorized mechanism used to open and close an opening such as an electric windscreen wiper, comprising a touch-sensitive surface which controls the opening and/or closing of at least one opening. The device comprises means for detecting (9) the charge applied to the touch-sensitive control surface and means (11) for inhibiting control of the opening and/or closing when the applied charge is outside an acceptable predefined charge range.

19 Claims, 1 Drawing Sheet

TOUCH-SENSITIVE SURFACE ACTIVATION DEVICE FOR THE CONTROLS OF A VEHICLE

CROSS REFERENCE TO RELATED APPLICATION

This application claims the benefit of International Patent Application PCT/EP2005/056564 filed Dec. 7, 2005, which application claims priority from FR application number 0413609, filed Dec. 20, 2004.

The present invention relates to a touch-sensitive surface activation device, of a motorized mechanism for opening and/or closing at least one opening element such as a motorized window, a sunroof, a trunk with motorized closure/opening assistance, a motorized tailgate or else a motorized sliding side door.

It is usual for the control of these members to provide an operating device in the form of switches or sometimes of a lever that can be actuated in four directions, often called a "joystick".

More recently, it has also been proposed to use for these controls touch-sensitive surfaces making it possible to detect a simple pressure of the driver's finger and, depending on the position in X, Y of the detected pressure and/or of the subsequent movement of this pressure on the surface, to initiate a particular type of action or command of a member of the vehicle. Reference may be made for example to documents FR 2 798 329, FR 2 800 885 and U.S. Pat. No. 6,157,372. These touch-sensitive surfaces may be of any type and use various technologies.

Although the use of such touch-sensitive surfaces is indisputably moving in the direction of better user-friendliness and an increased compactness of the control devices, it may on the other hand increase the risk of unintentional control errors.

Therefore, in the context of motorized opening elements such as windows, the sunroof or else the trunk and/or the rear tailgate, attention must be paid to the safety aspect, particularly during the closure of the opening element.

This problem is more widely known as "trap prevention" and relates to the danger that an opening element presents during closure, in particular for the limb of a user placed in the closure path and constituting a risk of trapping the limb.

To date, many solutions have been proposed for detecting that an object is in the closure path of the opening element.

These solutions usually deal with the detection of a resistance to the closure, which is likened to an object blocking the closure of an opening element, and the drive motor is stopped to prevent further material or bodily harm. It is therefore a direct treatment of a problem by complex and costly mechanical and electronic means.

The Applicant has found that preventive management of the controls of the opening elements may provide a significant enhancement, in particular in relation to the abovementioned touch-sensitive surfaces, for passive safety.

The object of the invention is to propose a new solution for a touch-sensitive surface activation device of a motorized mechanism for opening and/or closing an opening element making it possible to increase passive control safety.

Accordingly, the subject of the invention is a touch-sensitive surface activation device of a motorized mechanism for opening and/or closing an opening element, comprising a touch-sensitive surface for controlling the opening and/or closure of at least one opening element, characterized in that it comprises means for detecting the load applied to said touch-sensitive control surface and means for disabling the opening and/or closure control when the load applied is outside a predefined admissible load range.

Other advantages and features will appear on reading the description of the invention and the appended drawings in which:

FIG. 1 shows schematically a touch-sensitive surface activation device 1 of a motorized mechanism (not shown) for opening and/or closing an opening element, such as for example a window of a motor vehicle, a sunroof or else the motorized trunk/tailgate/sliding door of a vehicle.

The device comprises a touch-sensitive control surface 3 for the opening and/or closure of at least one opening element, accessible for a user, in particular a finger of the latter, by a downward movement, that is to say by exerting a certain pressure on the touch-sensitive surface of the sensor. Its first destination is to locate the place of the touch in X and/or Y coordinates (represented in the reference frame—the direction Z being perpendicular to these two directions X and Y).

The touch-sensitive surface may, enumerated nonexhaustively and nonlimitingly, be a touch-sensitive sensor with a matrix of resistors, a matrix-based capacitive sensor, a matrix-based pressure sensor or else a matrix/series of individual contacts placed beneath a layer of an elastic material so that a pressure on the "touch-sensitive" layer actuates one or more of the individual contacts whose change of state is used for the control.

On the upper surface 3 of the touch-sensitive surface, pictograms are represented in the form of arrows, where the arrow 5 indicates a zone making it possible to close the window and the arrow 7 indicates a zone for opening the window.

Figure 1:
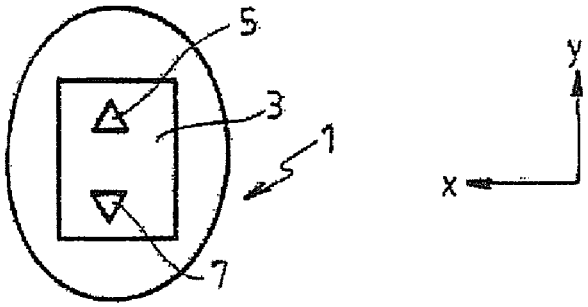
FIG. 1 is a diagram of a touch-sensitive surface activation device of a first embodiment of a touch-sensitive surface according to the invention.
Figure 2:
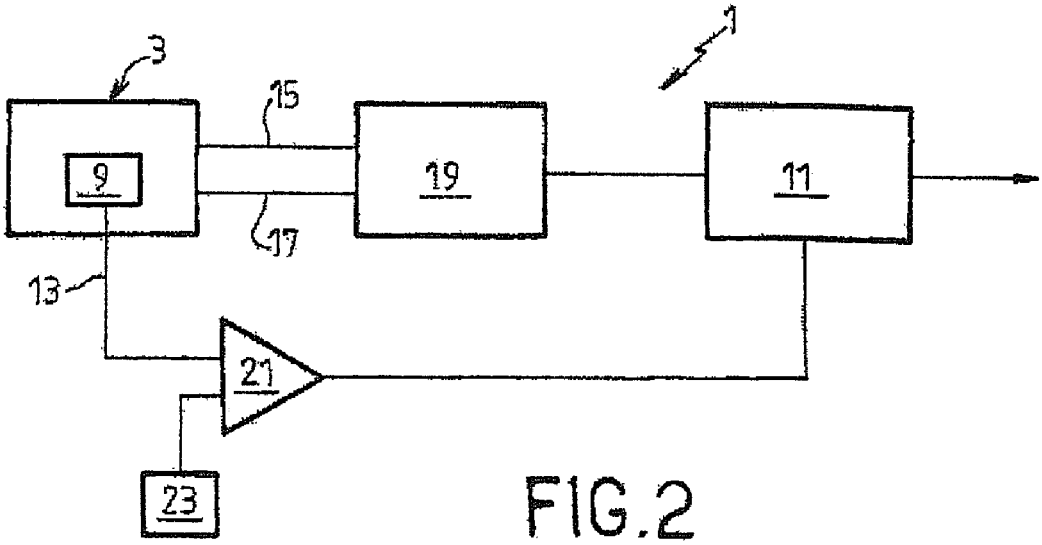
FIG. 2 is a block diagram of the device of FIG. 1.

With reference to the block diagram of FIG. 2 representing a first embodiment of the invention, the device 1 comprises means 9 for detecting the load applied to said touch-sensitive control surface and means 11 for disabling the opening and/or closure control when the load applied is outside a predefined admissible load range.

Preferably, the touch-sensitive sensor is chosen so as not only to detect the touch of a user in order to extract therefrom the location in X and/or Y coordinates, but also a parameter proportional to the load applied to the touch-sensitive surface. In this case, it has an output 13 of a signal proportional to the load applied. This output signal is applied to the input of a comparison unit 21 and compares this signal with applied load values stored in a memory 23. The output signal from the comparison unit 21 corresponding to an item of information, for example binary information, indicating whether the load applied to the surface is or is not within the authorized range.

According to FIG. 2, the sensor also has two outputs 15 and 17 corresponding to signals making it possible to locate the X and/or Y coordinates on the surface of the sensor in order to locate the place touched by the user, and therefore to generate, according to the X and Y coordinates received in a processor unit 19, the appropriate command to open or close the opening element in question.

Both the output of the processor unit 19 and the output of the comparison unit 21 are applied to corresponding inputs of the disabling unit 11.

If therefore this unit 11 receives from the comparison unit 21 a signal indicating that the load applied is outside the admissible load range, it disables the control signal, so that the opening elements concerned remain immobile.

On the other hand, if the load applied is within the admissible range, the control signal passes through the unit 11 and the opening element will make the requested movement.

Therefore, any inadvertent control, for example with the foot of a child standing on the door in which the activation device is incorporated, is not transmitted, which considerably increases the passive safety, that is to say the prevention of an undesirable control.

The lower limit of the admissible range may be 0 g, but preferably a lower limit of said admissible range corresponding to the load of a weight of approximately 30 g is chosen, which prevents a brushing of the touch-sensitive surface leading to an inadvertent control.

Preferably, the upper limit of said admissible range corresponding to the load of a weight of approximately 3 kg is chosen. Therefore, a heavy inadvertent pressure does not lead to an inadvertent movement of the opening element.

Naturally, the parameter reflecting the load pressing on the touch-sensitive surface may be the pressure, a bending (also called the sag) or any other equivalent parameter.

Figure 3:
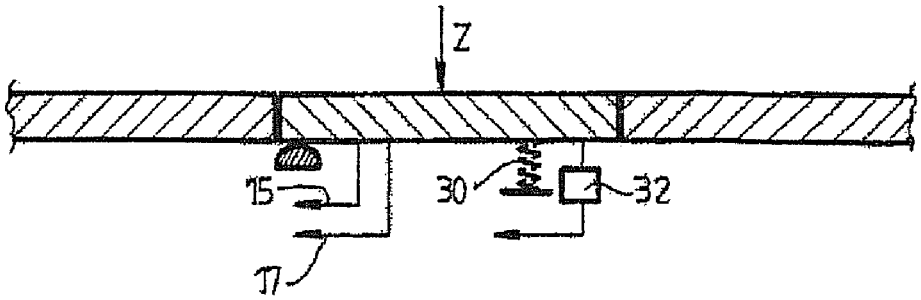
FIG. 3 is a diagram of another embodiment of the touch-sensitive surface portion of the activation device according to the invention.

According to a second embodiment shown in FIG. 3, the touch-sensitive surface is mounted so that an applied load causes a predefined movement of said surface. It is understood therefore that the touch-sensitive surface 3 is mounted with a certain possible mobility, either a movement in the direction Z (see the arrow in FIG. 3), or a certain pivoting movement or else a certain deformation/bending of the surface, which leads to the fact that said predefined movement may be a translation movement parallel to the normal of the touch-sensitive surface, a pivoting movement of the touch-sensitive surface or else a bending of said touch-sensitive surface.

The means for detecting said applied load comprise, placed beneath said touch-sensitive surface 3, on the one hand an elastic means 30, a spring, preferably a coil spring or an elastic stop, preferably made of rubber, and on the other hand a switch 32 to disable the opening and/or closing control of the opening element, so that, in the case of the application of a load greater than the upper limit of said admissible range, said touch-sensitive surface deforms said elastic means and causes the actuation of said switch.

When the switch is actuated, the control signal is disabled and the opening element remains immobile despite the application of a load on the touch-sensitive surface.

In a preferred enhancement, it is the elastic resistance of the switch for achieving the closure of the latter that forms said elastic means 30. It is therefore understood that the load necessary to actuate the switch is designed so that said elastic means are formed by the switch itself.

In this case, the switch is therefore designed so that only a load greater than the upper limit of said admissible range manages to actuate it. Advantageously, for this enhancement, the switch is an elastic contactor blade switch.

Naturally, for the switch to be able to disable the opening and/or closure control, it is sufficient for there to be a change of state of the switch from opening to closure or vice versa.

The invention is claimed is:

1. A touch-sensitive surface activation device of a motorized mechanism for opening and/or closing an opening element of a motor vehicle, the device comprising:

a touch-sensitive surface comprising a matrix based sensor for controlling the opening and/or closure of at least one opening element, said touch sensitive surface comprising:

means for measuring a load pressure value applied to said touch-sensitive control surface; and means for disabling the opening and/or closure control when the load pressure value is outside a predefined admissible load range with an upper limit and a lower limit.

2. The device as claimed in claim 1 wherein said lower limit of said admissible range corresponds to the load of a weight of approximately 30 g.

3. The device as claimed in claim 1 wherein said upper limit of said admissible range corresponds to the load of a weight of approximately 3 kg.

4. The device of claim 1 wherein the means for measuring the applied load pressure value are formed by said touch-sensitive surface made so as to be able to measure a parameter of the load applied to said surface.

5. The device as claimed in claim 4, wherein the means for detecting the applied load are formed by said touch-sensitive surface made so as to be able to measure the pressure or a weight exerted on said touch-sensitive surface.

6. A touch-sensitive surface activation device of a motorized mechanism for opening and/or closing an opening element of a motor vehicle, the device comprising:

a touch-sensitive surface comprising a matrix based sensor for controlling the opening and/or closure of at least one opening element, said touch sensitive surface comprising:

means for detecting a load pressure value applied to said touch-sensitive control surface: and means for disabling the opening and/or closure control when the load pressure value is outside a predefined admissible load range with an upper limit and a lower limit wherein:

said touch-sensitive surface is mounted so that an applied load causes a predefined movement of said surface; and the means for detecting said applied load is placed beneath said touch-sensitive surface and comprises:

an elastic means; and a switch, said elastic means and said switch operable for disabling the opening and/or closure control of the opening element such that, in response to a load greater than the upper limit of said admissible range being applied, said touch-sensitive surface deforms said elastic means and causes the actuation of said switch.

7. The device as claimed in claim 6, wherein said predefined movement is a translation movement parallel to the normal of said touch-sensitive surface.

8. The device as claimed in claim 6, wherein said predefined movement is a pivoting movement of the touch-sensitive surface.

9. The device as claimed in claim 6, wherein said predefined movement is a bending of the touch-sensitive surface.

10. The device as claimed in claim 6, wherein said elastic means comprise a spring.

11. The device as claimed in claim 10, wherein said elastic means comprises a coil spring.

12. The device as claimed in claim 6 wherein said elastic means comprise an elastic stop.

13. The device as claimed in claim 12, wherein said elastic stop is provided from rubber.

14. The device as claimed claim 6 wherein the load necessary to actuate the switch is selected such that said elastic means are formed by the switch itself.

15. The device as claimed in claim 14, characterized in that said switch is an elastic contactor blade switch.

16. A touch-sensitive surface for controlling at least one opening element, said touch sensitive surface comprising:

a matrix based sensor for controlling the opening and/or closure of at least one opening element means for measuring a load pressure value applied to said touch-sensitive surface; and means for disabling an opening and/or closure control when the load pressure value is outside a predefined admissible load range with an upper limit and a lower limit.

17. The device of claim 16 wherein said means for measuring the applied load pressure value are formed by said touch-sensitive surface so as to be able to measure a parameter of the load applied to said surface.

18. A touch-sensitive surface for controlling at least one opening element, said touch sensitive surface comprising:

a matrix based sensor for controlling the opening and/or closure of at least one opening element means for detecting a load pressure value applied to said touch-sensitive surface; and means for disabling an opening and/or closure control when the load pressure value is outside a predefined admissible load range with an upper limit and a lower limit wherein said touch-sensitive surface is adapted to be mounted such that an applied load causes a predefined movement of said surface.

19. The device of claim 18 wherein said means for detecting said applied load is placed beneath said touch-sensitive surface and comprises:

an elastic means; and a switch with said elastic means and said switch coupled and operable to disable an opening and/or closure control of an opening element such that, in response to a load greater than the upper limit of an admissible range being applied, said touch-sensitive surface deforms said elastic means and causes the actuation of said switch.

* * * * *